United States Patent [19]

Prus et al.

[11] Patent Number: 4,928,880

[45] Date of Patent: May 29, 1990

[54] PUMPED COATING PRODUCT SPRAYING INSTALLATION

[75] Inventors: Eric Prus, Grenoble; André Frene, Vourey; Pascal Bordaz, Domene; Patrick Guerange, Tullins; Caryl Thome, Saint Egreve, all of France

[73] Assignee: Sames S.A., Meylan, France

[21] Appl. No.: 191,955

[22] Filed: May 9, 1988

[30] Foreign Application Priority Data

May 19, 1987 [FR] France ..... 87 06969
Jun. 5, 1987 [FR] France ..... 87 07939

[51] Int. Cl.[5] ..... B05B 12/04; B05B 12/14

[52] U.S. Cl. ..... 239/8; 239/112; 239/305

[58] Field of Search ..... 239/304, 305, 307, 112, 239/8, 68, 71; 417/43

[56] References Cited

U.S. PATENT DOCUMENTS

| | | | |
|---|---|---|---|
| 3,462,081 | 8/1969 | Gelin et al. | 239/112 |
| 3,477,870 | 11/1969 | Boretti et al. | 117/105.3 |
| 3,974,879 | 8/1976 | Nelson, Jr. et al. | 169/43 |
| 4,204,612 | 5/1980 | Schrader et al. | 222/40 |
| 4,234,007 | 11/1980 | Titone et al. | 417/43 |
| 4,509,684 | 4/1985 | Schowiak | 239/305 |
| 4,510,397 | 4/1985 | Schroeder, Jr. | 290/43 |
| 4,549,676 | 10/1985 | Gerich | 239/112 |
| 4,614,300 | 9/1986 | Falcoff | 239/71 |
| 4,714,179 | 12/1987 | Otterstetter et al. | 239/112 |
| 4,728,034 | 3/1988 | Matsumura et al. | 239/112 |
| 4,745,011 | 5/1988 | Fukuta et al. | 239/112 |

FOREIGN PATENT DOCUMENTS

| | | |
|---|---|---|
| 3221326 | 6/1983 | Fed. Rep. of Germany . |
| 32213227 | 9/1983 | Fed. Rep. of Germany . |
| 2091911 | 8/1982 | United Kingdom . |

OTHER PUBLICATIONS

Patent Abstracts of Japan, vol. 6, No. 15 (C-89) [893], Jan. 28, 1982.

Japanese Patent Application No. 56-139 162 (Nippon Ransburg K.K.) 10.30.1981.

Patent Abstracts of Japan, vol. 9, No. 180 (C-293) [1903], July 25, 1985.

Japanese Patent Application No. 60-51 566 (Itouki Kousakushiyo K.K.) 03.23.1985.

*Primary Examiner*—Andres Kashnikow
*Assistant Examiner*—Karen B. Merritt
*Attorney, Agent, or Firm*—Sandler, Greenblum & Bernstein

[57] ABSTRACT

An installation for spraying a coating product in liquid form, as in the automobile industry, comprises at least one circuit and, in that circuit, a pump, at least one sprayer, and a flexible conduit connecting an outlet of the pump to the sprayer. The flowrate of liquid in the conduit is controlled by a servo-system which controls the pump. The pump is preferably a gear pump.

14 Claims, 2 Drawing Sheets

PUMPED COATING PRODUCT SPRAYING INSTALLATION

BACKGROUND OF THE INVENTION

1. Field of the invention

The invention concerns a coating product (for example, paint or varnish) installation of the type comprising a pump feeding at least one sprayer. The invention is more particularly concerned with a number of improvements relating to such use of a pump; it is also directed to various applications of the inventive principle in installations of different kinds.

2. Description of the prior art

A known paint spraying installation, preferably provided with a programmed automatic control color changing system, comprises a plurality of circuits conveying paint of different colors, which will be referred to hereinafter as "primary circuits", in each of which paint circulates continuously around a relatively long path, rinsing product feed means, also in the form of a continuous circulation circuit, compressed air supply means and a set of selectively operable valves and control systems forming what is generally called a "color change system" comprising at least one outlet connected to one or more sprayers located in a paint spraying booth. The objects to be painted pass through said booth. This type of installation is more typical of the automobile industry in which one of the most severe operating constraints results from the fact that two successive objects (automobile bodies) in the booth are not generally to be painted the same color, which makes it necessary to be able to carry out an entire color change sequence during a short time period not exceeding the time needed to bring the next object into position in the booth.

In this type of installation it is known to raise the coating products to a relatively high pressure (6 to 7 bars) on the inlet side of the color change system, in other words in the primary circuits, to obtain a sufficiently high pressure at the sprayer. A pressure regulator is generally provided near the sprayer and the conduit in which the paint travels from the color change system to the sprayer is of relatively large cross-section to minimize head losses. This leads to the wastage of non-negligible quantities of paint and rinsing product (solvent) on each color change cycle. The time to perform a color change can also become excessive in certain cases. Moreover, these problems are accentuated if it is necessary to provide a long length of conduit in the booth, which is the case when the sprayer or sprayers is or are mounted on multi-axis robots designed to move inside the booth.

Faced with such difficulties, it has been proposed to insert a pump (and in particular a pump whose flowrate is proportional to the drive speed, of the gear pump type) between the color change system and the paint sprayer or sprayers. As the pump is located near the color change system, head losses in the conduit can be compensated for, irrespective of its length, and it is even possible to reduce significantly the cross-section of the conduit, reducing the wastage of products during a color change cycle, while also reducing the time necessary to perform a color change cycle. It is also possible to reduce the pressure in the primary circuits, typically from 6–7 bars to 3–4 bars. The invention is concerned with improvements to this type of installation. Installations of this kind have been found to be somewhat unreliable, requiring frequent adjustment of the pump flowrate. The invention is the result of investigations into the causes of this lack of reliability.

These showed that the component parts of the gear pump used under such conditions wear more rapidly than in other industrial applications and that this wear results in internal leakage, in other words the existence of a fluid flowrate that is not directly related to the drive speed of the pump. In fact, such leakage exists even when the pump is brand new, although it is then at a very low level; it is its variation in time that eventually compromises correct functioning of the system. The direction and magnitude of such internal leakage depend, among other things, on the pressure difference between the pump inlet and outlet and on the viscosity of the product passing through it. Firstly, the invention provides a solution to this problem.

SUMMARY OF THE INVENTION

The invention consists in an installation for spraying a coating product in liquid form, comprising at least one circuit and, in said at least one circuit, a pump, at least one sprayer, a flexible conduit connecting an outlet of said pump to said at least one sprayer and servo-control means for controlling the flowrate of said liquid in said conduit adapted to control said pump.

Although the pump mentioned hereinabove is preferably a gear pump, in particular because it is relatively simple to rinse out this type of pump, the basic inventive concept is applicable to any type of pump.

The pump is coupled to an electric drive motor, preferably a self-regulated synchronous motor.

According to another important feature of the invention, the aforementioned servo-control means comprise a flowrate sensor in said circuit on the outlet side of said pump. This flowrate sensor preferably is of similar construction to a gearpump, featuring minimal head losses.

Moreover, as will emerge later, the invention is advantageously applicable to the use of two-constituent coating products (paint or varnish + hardener) by providing two circuits as defined hereinabove. The ratio with which the two constituents are mixed can be accurately adjusted by means of the two flowrate control means used conjointly.

A manually controlled coating product sprayer can easily be used in the context of the invention. All that is necessary is to use an appropriate transducer to reproduce the movement imparted by the user to the manual control device of the sprayer and to use the signal produced by the transducer as a variable set-point signal for said control means.

Finally, a pressure regulator may be inserted on the inlet side of the or each pump. A pressure regulator is a known sub-system routinely used in this art. In this way the invention makes provision for better use of the installation connected to means forming a "color change system", themselves fed by a plurality of primary circuits, conveying paint of different colors, for example, a rinsing product and compressed air. The incorporation of this pressure regulator makes it possible to reduce still further the minimum feed pressure of the pump and also to vary this minimum feed pressure at will during the performance of a predetermined operating cycle of the installation.

The invention will be better understood and other advantages of it will emerge more clearly from the following description of various embodiments of an installation in accordance with the invention given by way of example only and with reference to the appended drawings.

DESCRIPTION OF THE PREFERRED EMBODIMENTS

Figure 1:
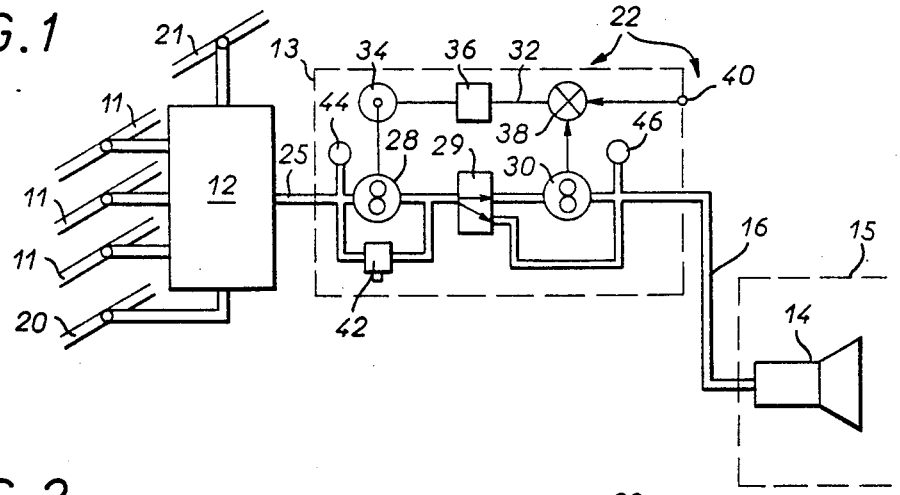
FIG. 1 is a block schematic of an installation in accordance with the invention.

With particular reference to FIG. 1, there is shown a paint spraying installation with a color changing system. This installation comprises a plurality of primary circuits 11 conveying paint of respective different colors, a color change system 12 that is known in itself, a motorized pump 13 into which the essential elements of the invention are incorporated and at least one paint sprayer 14 placed in a booth 15 through which objects to be painted (not shown) pass. It should be noted that the layout of these sub-systems is not immaterial. The motorized pump 13 is installed near the color change system 12 (at a distance in the order of 1 meter) and outside the booth 15. Because of this the conduit 16 between the outlet from the motorized pump 13 and the sprayer 14 is relatively long (typically in the order of 12 meters), especially if the sprayer 14, mounted on a robot, has to be able to move inside the booth during a paint spraying phase. The cross-section of the conduit 16 is nevertheless relatively small, the presence of a pump making it possible to compensate for head losses.

The primary circuits 11, of which only the parts connected to the color change system 12 are shown, are in reality long conduits each defining a closed circuit. Each circuit 11, in which the paint circulates continuously, communicates with a storage tank of paint of a particular color, remotely sited in the plant. Each primary circuit 11 is therefore connected to the corresponding inlets of the or each color change system 12.

A solvent or rinsing product circuit 20 of similar construction to a primary circuit conveying paint is connected to a specific inlet of the color change system 12. Another circuit 21 distributes compressed air and is connected to another specific inlet of the color change system 12. The whole of this arrangement is well known in itself and the manner of controlling and sequencing the opening and closing of the valves incorporated in the color change system is conventional and does not form any part of the invention.

The outlet 25 of the color change system 12 is connected to the sprayer 14 by a circuit 22 including in succession the motorized pump 13 and the conduit 16. The motorized pump 13 comprises in succession a pump 28, in this instance of the gear type, the inlet of which is connected directly to the outlet 25 of the color change system, a three-way, by-pass valve 29, a flowrate sensor 30 and flowrate servo-control means 32 arranged as a control loop between the sensor 30 and the pump 28. These control means are conventional in themselves and will be described only in outline.

An electric motor 34 is mechanically coupled to the pump 28 to drive it in rotation. It is a self-regulated synchronous motor, known in itself, and therefore associated with control means 36 designed to produce a variable frequency AC voltage driving the motor. The control means are themselves controlled by a signal produced by a comparator 38 deriving an error signal from a first signal applied to a set-point input 40 and a second signal produced directly or indirectly by the flowrate sensor 30.

The mechanical part of the flowrate sensor 30 is in this instance very similar from the constructional point of view to a gear pump. The fluid is fed between two meshing gears, causing them to rotate. One of the gears is fastened to a shaft connected to any form of transducer (not shown) producing an electrical signal used by the comparator 38.

The three-way, by-pass valve 29 comprises two outlets and one inlet. The latter is connected to the outlet of the pump 28. One of the outlets is connected to the inlet of the flowrate sensor 30 and the other to the outlet of the latter. With this arrangement it is possible to take the flowrate sensor 30 out of circuit during a color change cycle or part thereof and therefore to protect it from the abrupt changes in operating conditions resulting from the succession of products of different kinds and of very different viscosities in the conduit, such as paint, solvent and air. This avoids wear of and damage to the flowrate sensor.

Various safety devices are also provided, for example a safety valve 42 connected in parallel with the pump 28, a pressure sensor 44 on the inlet side of the pump and a pressure sensor 46 on the outlet side of the flowrate sensor 30. The two pressure sensors are used to monitor the presence of a product when the pump 28 is operated. A pump of this kind "binds" rapidly if operating with no fluid present. Also, the sensor 46 makes it possible to avoid accidents resulting from an increase in pressure when the sprayer or sprayers 14 is or are shut off. The safety valve 42 is calibrated to open at a particular pressure (15 bars, for example) and recycles the product in the event of an overpressure.

As already mentioned, the presence of the pump 28 makes it possible to use a lower pressure in the primary circuits 11 and to reduce the cross-section of the conduit 16, head losses being compensated for by the action of the pump. Also, any variation in the internal leakage of the pump 28 is corrected by the servo-control means 32, resulting in highly stable and reliable operation and avoiding frequent replacement of the pump 28. The achieving deployed in accordance with the invention further make it possible to increase productivity by increasing a significant time saving when changing color. With these arrangements, just before the end of a paint spraying phase it is possible to "propel" the paint already in the circuit 22, and in particular in the conduit 16, using the solvent or rinsing product. Thus cleaning of the circuit 22 begins before application of paint to the object being processed ends. This has not been done previously because of the difference between the viscosity of the paint and that of the rinsing product, which would have caused a large variation in the flowrate of the paint at the outlet from the sprayer 14. Propulsion by the solvent remains perfectly stable, however, by virtue of the flowrate regulation. It is therefore sufficient for the valve switching means in the color changing system to be controlled in such a way as to anticipate the introduction of the rinsing product into the circuit 22, relative to the end of the phase in which paint is sprayed onto a given object in the booth 15. In this way the various component parts of the motorized pump 13 are already virtually clean when the rinsing cycle proper begins, characterized by successive injection of rinsing products and air into circuit 22. The flowrate sensor 30 in particular is quickly cleaned because of its construction, with the result that it can be protected subsequently by switching the valve 29.

Figure 2:
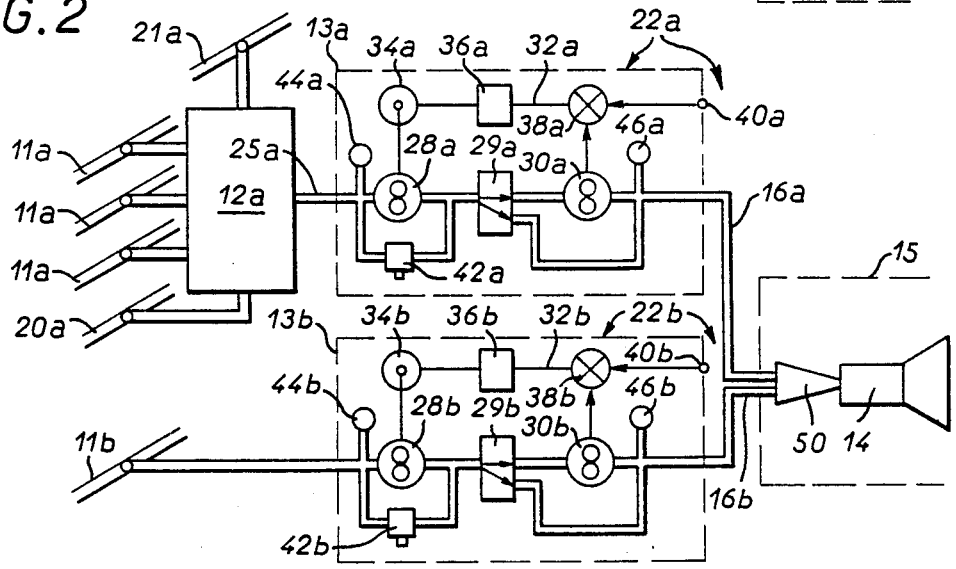
FIG. 2 is another block schematic showing the application of the inventive principle to the use of a two-constituent coating product.

FIG. 2 shows an installation for spraying a two-constituent coating product, one of the constituents serving as a hardener, for example. This may be a paint requiring the use of a hardener of this kind, for example, or a varnish. In an automated installation it is desirable to mix the two constituents continuously, as the mixture is used up. However, the relative quantities of the two constituents must be controlled extremely precisely. The invention makes it possible to achieve this objective. In the example shown, all structural components analogous to those in FIG. 1 carry the same reference numerals and will not be described in detail again. Also, the components conveying the "base" of the paint or varnish are indicated by the suffix a and the components conveying the hardener are identified by the suffix b. It will be seen that the part conveying the "base" of the paint or varnish is in all respects comparable with the FIG. 1 installation and comprises a circuit 22*a* comprising a pump 28*a* and servo-control means 32*a*. The circuit 22*a* is associated with a color change system 12*a*. Generally speaking this is not the case with the circuit 22*b* which is simply connected to a single hardener circuit 11*b*. However, in a situation where several types of hardener could be used selectively and mixed with different "bases" the circuit 22*b* could be associated with a system analogous to the color changing system already described. The two flexible conduits 16*a*, 16*b* are selectively connected to the two inlets of a mixer 50 placed near or incorporated into the sprayer 14. The relative proportions of "base" and hardener can be preset easily and precisely by adjusting the values of the set-point signals applied to inputs 40*a* and 40*b*.

Figure 3:
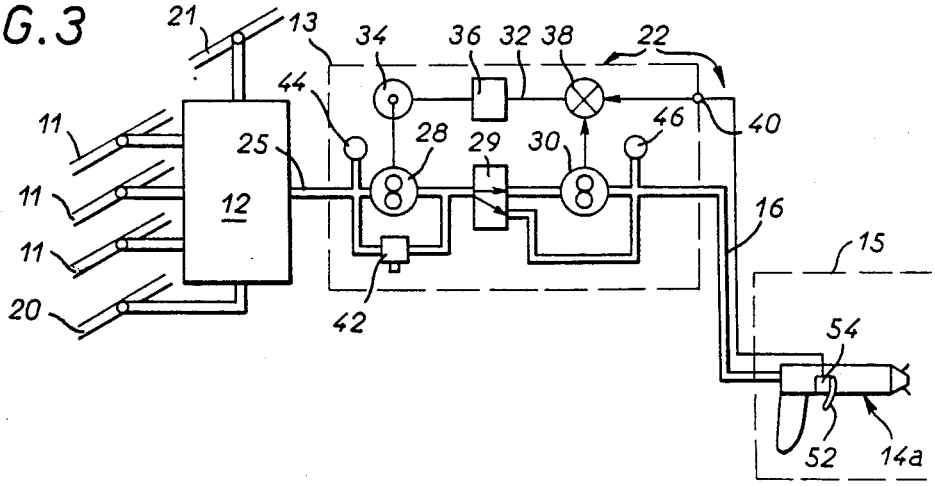
FIG. 3 is another block schematic showing the application of the inventive principle where a manually controlled sprayer is used.

FIG. 3 shows an alternative embodiment using an installation essentially similar to that of FIG. 1. It differs from the latter only in terms of the kind of sprayer 14*a* used. This is a manual control sprayer which therefore comprises a manual control member or "trigger" 52, the position of which is related to the flowrate of the product chosen by the user. According to one aspect of the invention, a transducer 54 is coupled to this control member 52 and the electrical signal output of this transducer is connected to the set-point input 40. The flowrate of the pump is therefore made variable according to the action of the user on the control member of the coating product sprayer.

Figure 4:
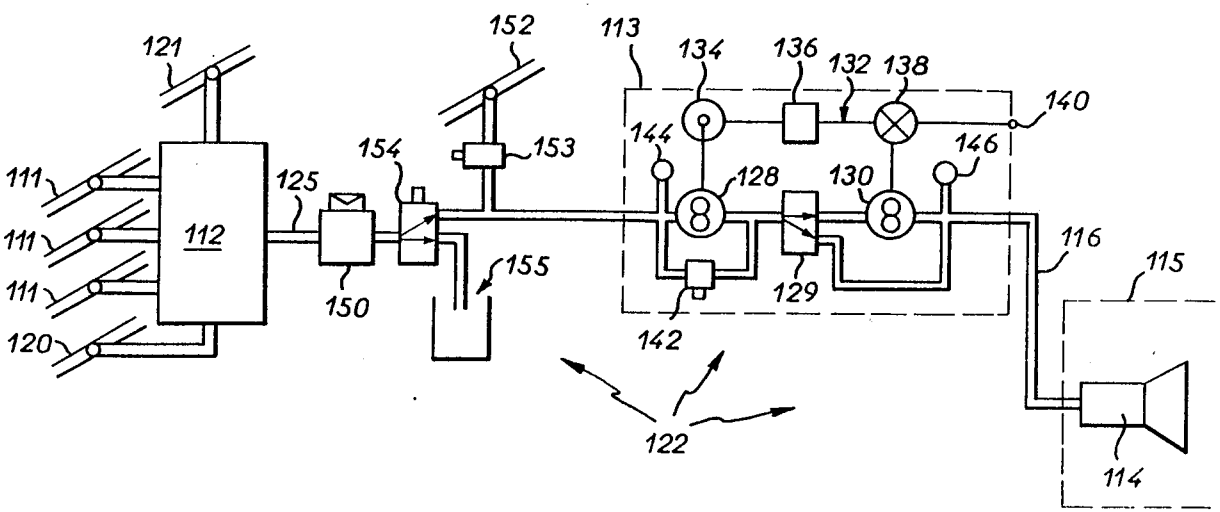
FIG. 4 is a block schematic of another embodiment of the installation.

In FIG. 4 the components analogous to those described with reference to FIG. 1 carry the same reference numbers increased by 100. They will not be described again in detail, nor will the way in which they are interconnected and cooperate with each other. The reader is merely reminded that this installation comprises several paint primary circuits 111, a color change system 112, a motorized pump 113 and at least one paint sprayer 114 located in a booth 115. As previously, the motorized pump 113 is installed near the color change system 112 (at a distance in the order of 1 meter) and outside the booth 115. Because of this the conduit 116 between the outlet of the motorized pump 113 and the sprayer 114 is relatively long (typically in the order of 12 meters) especially if the sprayer 114, mounted on a robot, has to be able to move inside the booth during a paint spraying phase. Nevertheless, the cross-section of the conduit 116 is relatively small, the presence of a pump making it possible to compensate for head losses.

The installation further comprises, as in the FIG. 1 example, a solvent or rinsing product circuit 120 and an air distribution circuit 121.

The outlet 125 of the color change system 112 is connected to the sprayer 114 by a circuit 122 including in particular the motorized pump 113 and the conduit 116. The motorized pump 113 comprises in succession a pump 128, in this instance a gear pump, a by-pass valve 129, a flowrate sensor 130 and flowrate servo-control means 132. These servo-control means comprise an electric motor 134 mechanically coupled to the pump 128 to drive it in rotation and associated control means 136 producing a variable frequency AC voltage driving the motor. The control means are themselves controlled by a signal produced by a comparator 138 deriving an error signal from a first signal applied to a set-point input 140 and a second signal produced directly or indirectly by the flowrate sensor 130. The mechanical part of the latter is in this instance very similar constructionally to a gear pump.

Various safety devices are further provided, as previously, in particular a safety valve 142, a pressure sensor 144 and a pressure sensor 146.

A pressure regulator 150 is inserted on the inlet side of the pump 128. To be more precise, this regulator is connected between the outlet 125 of the color changing system 112 and the inlet of the pump 128. Furthermore, supplementary rinsing product feed means, delivering the latter product at a relatively high pressure, are connected to the circuit 122 between the outlet of the pressure regulator 150 and the inlet of the pump 128. In this instance the rinsing product is taken from another circuit 152 in which it flows in a closed loop at a high pressure. The connection is made by a selector valve 153. A three-way selector valve 154 is connected between the outlet of the pressure regulator, the inlet of the pump 128 and a purge circuit 155. To be more precise, the outlet of the pressure regulator 150 is connected to the input of the valve 154, one outlet of this valve is connected to the inlet of the pump 128 and the other outlet of the same valve is connected to the purge circuit 155. The outlet of the valve 153 is connected to the circuit 122 between the valve 154 and the pump 128. Of course, the set-point of the pressure regulator may be modified as a predetermined cycle of operation unfolds, by conventional control means.

This arrangement has many advantages.

During the paint spraying phase the minimum feed pressure of the pump may advantageously have a value in the order of 2 bars, with the primary circuits 111 at a pressure between 4 and 5 bars. This minimum feed pressure is also advantageously stabilized irrespective of the nature of the equipment on the inlet side of the pump. On the other hand, the pressure can be increased beyond 3 bars, during the phase of filling the circuit 122 only, after a color change cycle. The phase in which the paint is "propelled" by the rinsing product may advantageously be performed at low pressure, the rinsing product being injected from the color changing system. In all cases the pressure at the pump inlet is relatively stable, which further increases its durability. In particular, the pump 128 is no longer subject to the variations transmitted by the primary circuits fed by reciprocating pumps. From one and the same set of primary circuits it is now possible to feed the pump 128 at low pressure for low flowrates and at higher pressure for high flowrates. It is therefore advantageously possible to use a different minimum feed pressure for the pump 128 for the spraying phase (where the pressure may be relatively lower) and the rinsing phase. This is part of the function of the supplementary pressurized rinsing product feed means including the circuit 152. This arrangement also makes it possible to save time during the color change cycle. When the part of the circuit 122 running from the pump 128 to the sprayer is cleaned by the pressurized rinsing product the part between the color changing system 112 and the valve 154 is cleaned simultaneously but more quickly (given its short length) by the rinsing product from the circuit 120. The remaining time is exploited to begin feeding the next paint as far as the outlet from the valve 154, while cleaning of the circuit 122 is being completed. This saves several seconds on each color change cycle.

There is claimed:

1. Installation for spraying a coating product in liquid form, comprising at least one circuit including a pump, at least one sprayer, a flexible conduit connecting an outlet of said pump to said at least one sprayer, and servo-control means for controlling the flow rate of liquid in said conduit to a set-point by controlling said pump; and rinsing product feed means and switching means capable of controlling said rinsing product feed means to introduce rinsing product into said at least one circuit prior to completion of a coating product spray sequence to thereby cause the rinsing product to propel the coating product towards said at least one sprayer.

2. Installation according to claim 1, wherein said pump is a gear pump.

3. Installation according to claim 1, further comprising an electric motor driving said pump.

4. Installation according to claim 3, wherein said electric motor is a self-regulated synchronous motor.

5. Installation according to claim 1, wherein said pump has an inlet side and an outlet side, and said servo-control means include a flowrate sensor in said flexible conduit on said outlet side of said pump.

6. Installation according to claim 5, wherein said flowrate sensor is of the gear type.

7. Installation according to claim 5, further comprising a selectively operable, by-pass valve connected to said flowrate sensor.

8. Installation according to claim 7, wherein said by-pass valve is a three-way valve comprising one inlet connected to the outlet of said pump and two outlets respectively connected to an inlet and an outlet of said flowrate sensor.

9. Installation according to claim 1, comprising two circuits each capable of conveying one constituent of said coating product, and a mixer in or near said at least one sprayer in which said two circuits are connected.

10. Installation according to claim 1, wherein said servo-control means comprise a set-point input, and said at least one sprayer comprises a manual control device, and further comprising a transducer with an input coupled to said manual control device, and an output connected to said set-point input.

11. Installation according to claim 1, wherein said pump has an inlet side and an outlet side, and further comprising a pressure regulator on said inlet side of said pump.

12. Installation according to claim 11, wherein said pressure regulator has a inlet side and an outlet side, and further comprising a color change system on said inlet side of said pressure regulator.

13. Installation according to claim 11, further comprising supplementary pressurized rinsing product feed means and a set of selector valves whereby said supplementary pressurized rinsing product feed means are connected between the outlet side of said pressure regulator and the inlet side of said pump.

14. A method of spraying a coating product in liquid form, comprising feeding the coating product through at least one circuit having a pump, at least one sprayer, a flexible conduit connecting an outlet of said pump to said at least one sprayer, and servo-control means for controlling the flowrate of liquid in said conduit to a set-point by controlling said pump; and activating switching means to feed a rinsing product through said at least one circuit prior to completion of a coating spray sequence to thereby cause the rinsing product to propel the coating product towards said at least one sprayer, with said servo-control means maintaining the flowrate of the rinsing product through said at least one conduit.

* * * * *